United States Patent [19]

Culler

[11] 4,169,671

[45] Oct. 2, 1979

[54] VARIABLE VOLUME CONTAINER FOR PROCESSING PHOTOGRAPHIC MATERIALS

[75] Inventor: Jimmie G. Culler, Dexter, Mich.

[73] Assignee: PhotoSystems, Dexter, Mich.

[21] Appl. No.: 896,063

[22] Filed: Apr. 13, 1978

Related U.S. Application Data

[63] Continuation of Ser. No. 682,883, May 3, 1976, abandoned, which is a continuation of Ser. No. 487,541, Jul. 11, 1974, abandoned.

[51] Int. Cl.[2] ..... G03D 17/00

[52] U.S. Cl. ..... 354/312; 354/331

[58] Field of Search ..... 354/312, 328–331, 354/335; 92/250; 220/93, 233, 234, 238

[56] References Cited

U.S. PATENT DOCUMENTS

| | | | |
|---|---|---|---|
| 2,770,510 | 11/1956 | Collins | 92/250 |
| 2,828,886 | 4/1958 | Thomas | 220/93 |
| 2,914,369 | 11/1959 | Hayman | 92/250 X |
| 2,947,236 | 8/1960 | Siegel | 354/330 |
| 3,164,289 | 1/1965 | Cocchiarella | 220/93 |
| 3,381,599 | 5/1968 | Banks | 354/328 X |
| 3,578,467 | 5/1971 | Huber | 220/93 X |
| 3,703,860 | 11/1972 | Wilkinson | 354/329 X |
| 3,705,544 | 12/1972 | Ratowsky | 354/329 X |
| 3,784,051 | 1/1974 | Shaw | 220/93 |

*Primary Examiner*—R. L. Moses

*Attorney, Agent, or Firm*—Neuman, Williams, Anderson & Olson

[57] ABSTRACT

Apparatus and method for processing a material, such as photographic film, by the application of fluids. The film is placed within a substantially cylindrical and hollow container. One end of this container is provided with a removable cover assembly. The cover assembly comprises a funnel through which fluids can be poured and a detachable cap to fit over the funnel forming an impermeable seal. A plug assembly is insertable into the opposite end of the cylinder and movable along the longitudinal axis thereof. The movement of the plug assembly varies the volume within the cylinder defined by the cover assembly, the inner walls of the cylinder and the plug assembly. The plug assembly is also lockable or securable so that it will form an impermeable seal at any position along the longitudinal axis of the cylinder. Therefore, the volume of the film container can be varied to correspond to the amount of film being processed. Since both ends of the film container are open, the plug assembly and cap element of the cover assembly can be removed and water run continuously in the unplugged opening and out of the uncapped opening providing a continuous fresh wash for the film in the container. The entire assembly provides thermal inertia to facilitate film processing, even with minimum amounts of chemicals, at controlled temperatures.

8 Claims, 4 Drawing Figures

VARIABLE VOLUME CONTAINER FOR PROCESSING PHOTOGRAPHIC MATERIALS

This is a continuation of application Ser. No. 682,883 now abandoned filed May 3, 1976 which is itself a continuation of application Ser. No. 487,541 now abandoned filed July 11, 1974.

PRIOR ART

There are numerous apparatus for developing photographic film in the prior art including developing trays and tanks. The prior art tanks such as the Johnsons of Hendon Universal Developing Tank have a static, fixed or invariable volume tank. In these tanks, the film to be developed is placed on an appropriate size reel and inserted into the tank. A jar top type assembly seals the only opening of the tank. The jar top type assembly has a removable cap providing a single opening into which fluids may be poured during the developing process. One limitation of these prior art tanks was that the volume was fixed. Therefore, if a two reel tank was used to develop a single reel, there would be a waste in chemicals, by an amount necessary to fill the unused volume of the two reel tank. Also, if two reels were to be developed and the photographer had only a single reel tank then the process must be repeated twice, e.g., one reel developed at a time. This limitation required the photographer to keep in stock a plurality of different size developing tanks or waste chemicals by using a single large size and dummy reels (reels without film) to fill the container. Even the repetitious use of the single reel tank for developing two or more reels results in a certain waste of chemicals when compared to a single multi-reel developing operation since in every operation a certain amount of chemicals are needed to fill unused portions in the tank structure (e.g., grooves, gaskets, etc.).

Another problem experienced in the prior art was maintaining the developing drum at the proper temperature throughout the entire process. This is particularly important in the high temperature (100° F. or more) color film processes. Yet another difficulty in the prior art was the washing of the film either between steps or after the completion of the developing process. In the prior art, the water had to be added in the same manner as the chemicals, then the drum agitated to properly wash the film and finally, the water dumped before the sediment from the previous developing step could settle back onto the film.

An object of the present invention is to provide a variable volume developing tank so that the volume can be changed to correspond to the amount of film to be developed.

A further object of the present invention is to provide a film container which is insulated for holding a constant temperature through the developing cycle.

A still further object of the present invention is to provide a developing tank which is open at both ends for passing a continuous flow of fresh water over the film during a washing step.

BRIEF DESCRIPTION OF THE DRAWINGS

Further and additional objects will appear from the following detailed description of a specific embodiment read in conjunction with the accompanying drawings, wherein.

SUMMARY OF THE INVENTION

The present invention is directed to processing material such as photographic film by the application of fluids. A substantially cyclindrical film container has two open ends. The first open end is provided with a removable cover assembly. The second open end is provided with a plug assembly. The film to be developed is placed on standard reels and if necessary to the developing process, the film cylinder is presoaked in constant temperature water. The cylinder is insulated and has substantial thermal inertia and will therefore, substantially hold this temperature through the developing process. The film container is also sized to the appropriate internal volume by placing the same number of empty reels into the film container (from either open end) as will be used to hold the film in the actual developing process. The plug assembly is movable within the film container to vary the volume defined by the plug assembly, inner wall of the film container and the cover assembly. The plug assembly is capable of being secured at any position within the film container to form an impermeable seal. The sizing operation is completed by moving the plug assembly along the inner wall of the film container varying the container's volume until it is only as large as is necessary for the amount of film being developed. Once the plug assembly reaches this position, the impermeable seal is formed. The empty reels are replaced with an equal number of reels loaded with film to be developed. The cover assembly is now sealed and the cap element of the cover assembly is removed so that appropriate developing fluid can be poured into the film container. The cap is then replaced and the film container agitated by manual rolling or by a mechanical device such as the UNICOLOR® Uniroller. In conventional developing tanks, the film is wound about a vertical axis and rotated about a vertical axis during processing requiring enough chemical to completely immerse the film. Much less chemical is required in using the instant invention where the film is wound about a horizontal axis and rotated about a horizontal axis. Once the agitation time period has elapsed, the cap is again removed, the used fluid poured out and the pouring in cycle repeated. If the step of washing is required, the cap element is removed and the plug assembly withdrawn from the film container. Now running water such as from a faucet is let flow in the unplugged opening over the film and out the uncapped opening.

DETAILED DESCRIPTION OF DRAWINGS

Figure 1:
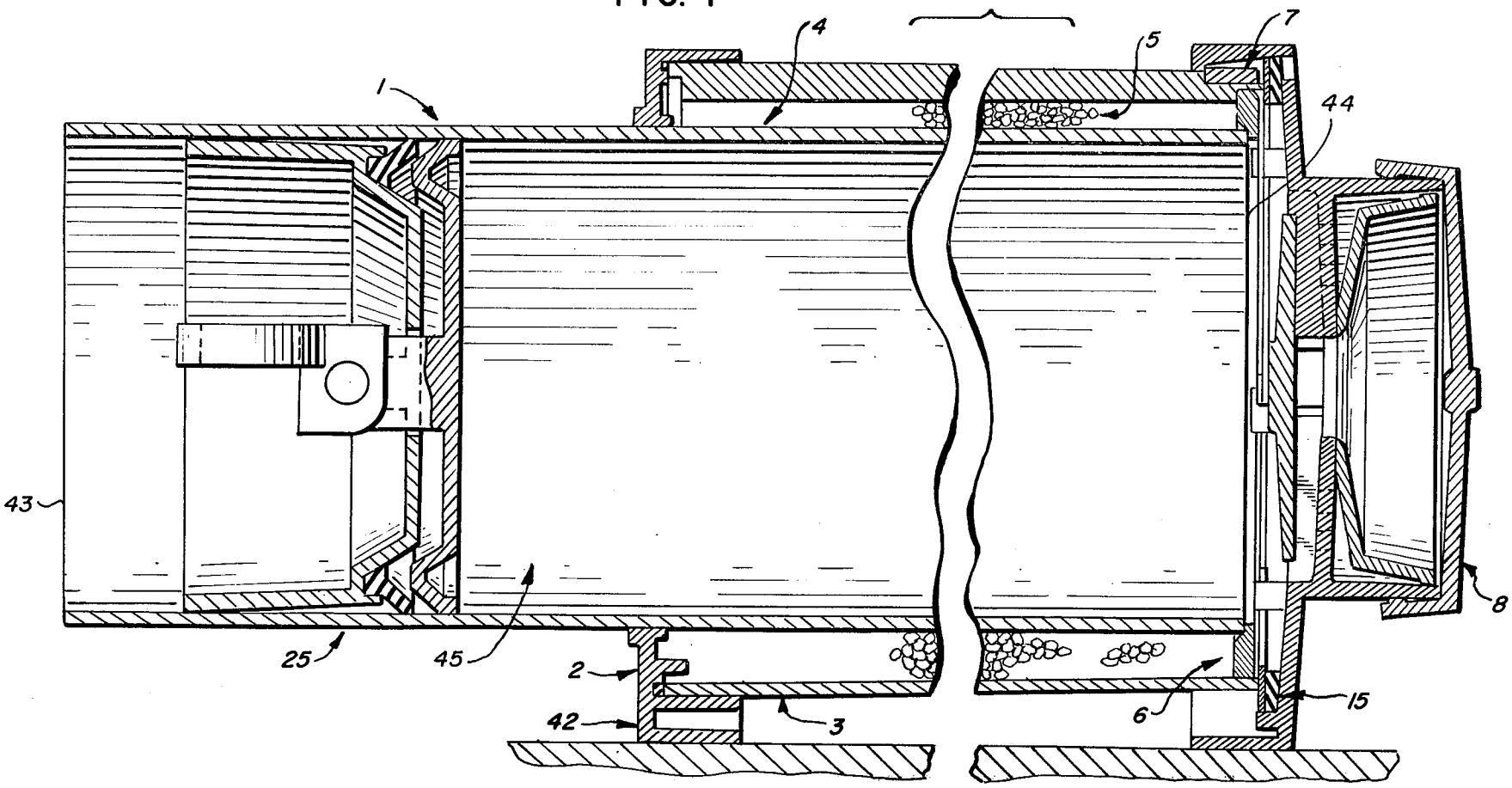
FIG. 1 is the preferred embodiment of the present invention.

The film drum, generally indicated in FIG. 1, includes a film deposit container 1 which is a substantially cylindrical and hollow tube-like member having first and second open ends 43 and 44 respectively and is made from plastic or the like. The cylindrical container is referred to throughout the disclosure but it is to be understood that other geometrical shapes which have the same attributes needed herein could be used. At a point about $\frac{3}{4}$ of the cylinder's longitudinal length an external annular support member 2 is mounted. The support has a general cross-sectional shape which is the same as the cross-sectional shape of the container 1 and is affixed to the container 1 by cementing or any other similar process which forms an air-tight seal. In insulating container 3, with the same geometric shape as the film container 1 but a greater diameter and shorter longitudinal length, is placed concentrically over the film container 1 until one end abuts the support member 2. The opposite end of the insulating container 3 extends to a point in space substantially even with one end of the film container 1. The abutting end of the insulating container 3 is sealed to the support member 2 by cementing or any other similar process by which an air-tight seal can be formed. Since the insulating container is of a greater diameter than the film container, a chamber 4 is defined therebetween. The support 2 forms the bottom of the chamber 4 while the film container 1 and the insulating container 3 form its walls. A measured quantity of Vermiculite 5 is poured into and substantially fills the chamber 4. Vermiculite is a standard insulating material and any other similar material could be used in its place provided only that it has low thermal conductivity and some thermal inertia or heat holding capability. A ring member 6 is secured over the annular opening of chamber 4. The ring 6 is cemented or the like between the edge of the film container 1 in the edge of the insulating container 3 forming an air-tight seal. The Vermiculite 5 is now sealed in chamber 4 which is substantially air-tight.

As an alternative embodiment, the container structure comprising the film container 1, insulating container 3, support member 2, and ring member 6 could be formed of a polyurethane or ABS foam. If this or a similar material is used, the purpose of the Vermiculite is eliminated since the material itself has adequate thermal properties. Therefore, the necessity of forming the dual concentric cylinders defining a chamber to be filled with insulating material is eliminated. Hence, a single unitary structure in the shape of a substantially cylindrical and hollow tube-like member made of insulating material such as polyurethane is an alternative to the preferred embodiment described above.

As a further alternative embodiment to the container structure of FIG. 1, the insulating container 3 could be substantially the same longitudinal length as the film container 1. The ends of the containers would be sealed together to form a chamber for the Vermiculite or other insulating material. The Vermiculite chamber could, therefore, extend over the entire length of the film container or to any point less than the entire length of the container.

A foot or extension 42 is mounted on the insulating container 3. The foot 42 acts as a stop during manual horizontal agitation of the drum during the developing process. The foot 42 can be attached by cementing or the like or made integral with the insulating container 3 or any other element of the container structure. A pluraity of locking tabs 7 are mounted in a spaced relationship circumferentially around the walls of the insulating container 3 close to the point where the ring member 6 is secured to the edge of the insulating container 3. A cover assembly 8 fits over the outer walls of the insulating container 3 and when rotated mates or locks with the tabs 7 sealing the cover assembly over the opening defined by the combined structure formed of the insulating container 3, the ring member 6 and the film container 1.

Figure 2:
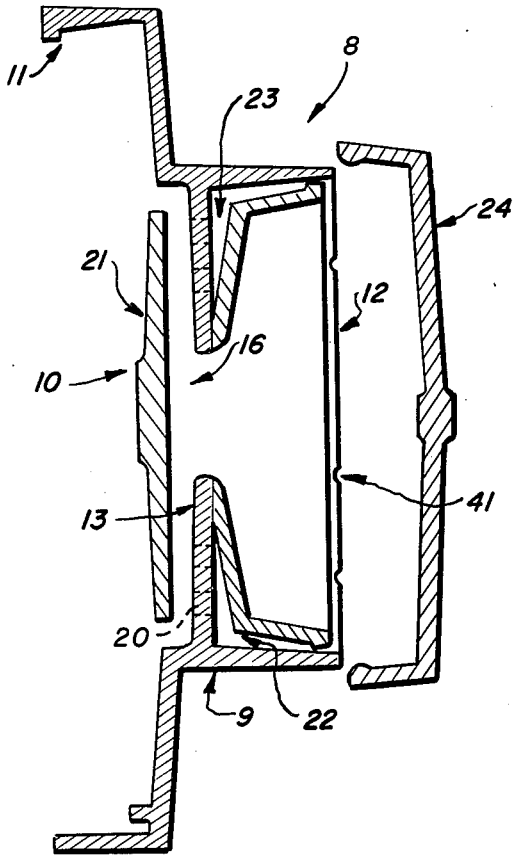
FIG. 2 is an illustration of the fluid-flow control cover assembly.

The fluid-flow control cover assembly 8 is illustrated in FIG. 2. A cover 9 forms the outer structure of the assembly. The cover 9 has a large diameter opening or mouth 10 which is sufficiently large to fit over the insulating container 3. This end of the cover 9 is provided with a plurality of extensions or locking ears 11 which mate with the tabs 7 when the cover assembly is rotated. The opposite end of the cover 9 has an opening 12, the diameter of which is smaller than the opening 10. At a point between the mouth 10 and the opening 12 the cover 9 forms a planar platform or shoulder 13 perpendicular to the longitudinal axis of the containers 1 and 3 when the extensions or locking ears 11 of the cover 9 are mated with a plurality of tabs 7.

Figure 3:
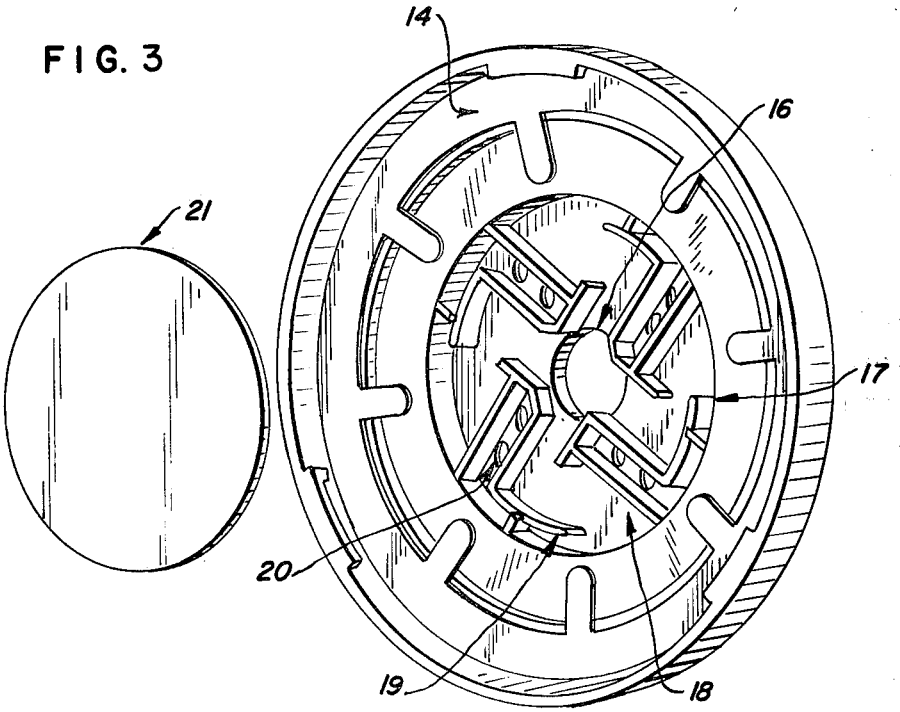
FIG. 3 is an oblique view showing the interior structure of the cover assembly of FIG. 2.

The planar platform or shoulder 13 is best illustrated in FIG. 3 which is an oblique view showing the interior structure of the cover assembly 8. In FIG. 3, the circumferential edge of opening 10 is visible. A gasket 14 fits within the circumferential edge of the shoulder 13 of cover 9 and over the sealing gasket 15 shown in FIG. 1. The gasket 14 will contact the ring 6 when the cover assembly 8 is placed over the container structure. A substantially planar platform or shoulder 13 defines an aperture 16 at its center point. The platform 13 has a substantially circular recess 17 concentric with the aperture 16 but of a greater diameter. In the recess 17 of platform 13, a plurality of fluid control vanes 18 are mounted. The vanes 18 extend from the perimeter of aperture 16 in a convoluted pattern towards the circumferential edge of the recess 17.

The vanes 18 are formed by thin side wall members 19 which are of a height slightly shorter than the depth of recess 17. Within the recess 17 of the shoulder 13 and positioned within the side wall member 19 which define each of the vanes 18 is at least one air aperture 20 extending through the shoulder 13. The air apertures 20 function to equalize the pressure between the interior of the film container 1 and the atmosphere so that fluid flows easily into or out of the container 1. Over the vanes 18 is mounted a flow directing plate 21 which is of the same generally circular shape as the recess 17 but is slightly smaller in diameter. A combination of the recess 17 is the platform 13, the vanes 18 and the plate 21 provide a smooth and steady fluid flow into and out of the film container 1. In addition, the above combination of element blocks direct light from entering the film container 1. Any light which enters through aperture 16 is reflected at least once and substantially attenuated along the convoluted path of the vanes 18 before reaching the interior of the film container 1.

A funnel 22 is attached by cementing or the like to the side of the planar platform 13 opposite the vanes 18 and surrounding aperture 16. The funnel 22 provides a smooth passage for fluid between the opening 12 and the aperture 16 in the platform 13. The funnel 22 completes the air path from the interior of film container 1 to the atmosphere by forming a channel 23 between the aperture 20 and the atmosphere, refer to FIG. 2. The above portion of the cover assembly 8 is made of component parts adhered together by cementing or the like; however, one or more of the parts may be integrally formed. This portion of the cover assembly is fitted over the container structure and sealed in a fluid-tight relationship by rotating the cover assembly 8 which mates extensions 11 with the plurality of tabs 7.

Over the cover 9 there is placed a removable cap 24. The cap 24 forms a fluid-tight pressed seal over the opening 12 and the channel 23. Other forms of removable fluid-tight seals could also be used. The cap is removed to allow fluid to flow into or out of the container 1. Thus, the cap of the fluid-flow control cover assembly 8 has two separate and selectable positions. The first position corresponds to having the cap 24 over the cover 9 forming an impermeable seal. The second position corresponds to having the cap 24 removed for permitting fluid flow into or out of the film container.

At the opposite end of the film container 1 in FIG. 1, a plug assembly 25 can be inserted. The plug assembly 25 is movable within the film container 1 along the container's longitudinal axis. As the plug assembly 25 is moved toward the cover assembly 8, the volume 45 within the container 1 is reduced. The container volume 45 is defined by the plug assembly 25, the cover assembly 8 and the interior walls of the film container 1. Conversely, as the plug assembly 25 is moved away from the cover assembly 8, the volume defined above increases rather than decreases. Therefore, it is clear that by the movement of the plug assembly 25, the internal volume 45 of the container 1 can be varied.

Figure 4:
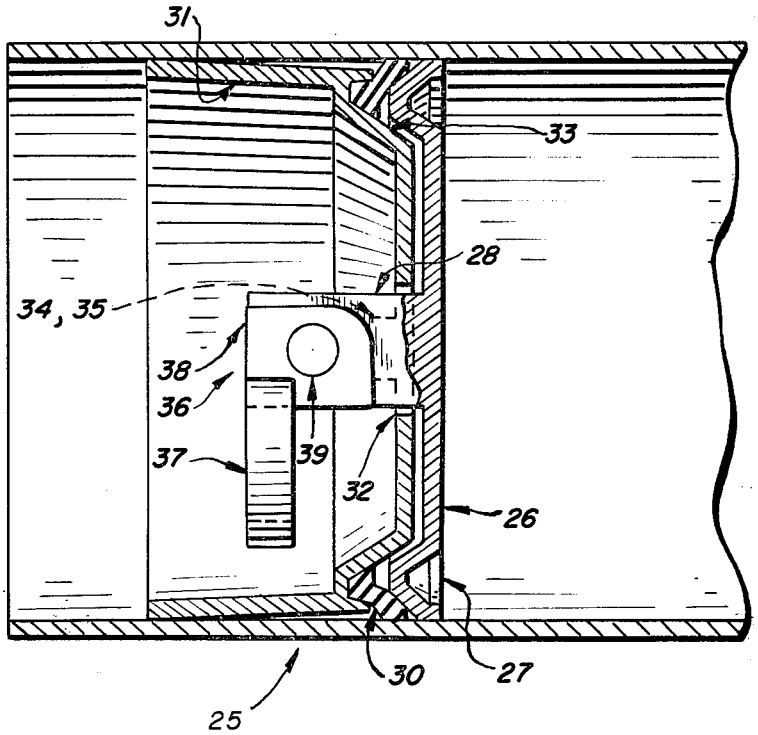
FIG. 4 is an illustration of the plug assembly.

The plug assembly 25 is illustrated in FIG. 4. The base plate 26 is substantially the same diameter as the inner walls of the film container 1, so that the plate 26 moves with a little frictional resistance within the container 1. A flange or collar portion 27 is formed near the peripheral edge of the base plate 26. An arm 28 stems from the center of plate 26. There is a hole 29 (not illustrated) in the arm 28. A gasket 30 made from a flexible material such as rubber, plastic, or the like fits over the arm 28 and contacts the flange or collar portion 27 of the plate 26. A cup member 31 fits over the gasket 30 and plate 26. The cup 31 has an elongated hole 32 in its base through which arm 28 of plate 26 extends. The base of the cup 31 has around its periphery a chamfered groove 33 in which the gasket 30 and the flange portion 27 of the plate 26 rest. On the interior side of the base of cup 31, that is the side opposite the chamfered groove 33, on both sides of hole 32 are two small studs 34 and 35. Ring member 36 integrally formed of the ring shape portion 37 and a substantially rectangular prong base section 38, the ring member 36 is attached to arm 28 of plate 26 by a pin 39 which extends through holes 40 (not illustrated) in the prong base section 38 of the ring member 36 and hole 29 and arm 28. The ring member 36 is connected to the arm 28 and rests on the studs 34 and 35. The studs 34 and 35 act as a focal point about which the base section 38 of ring member 36 pivots. When the ring member 36 is in the upright position (as illustrated in FIG. 1), the base plate 26 has the largest outside diameter of any component in the plug assembly 25, therefore, the plug assembly 25 passes with a slight frictional resistance along the interior walls of the film container 1. However, when the ring member 36 is pivoted to a downward position (as illustrated in FIG. 4) about the studs 34 and 35. the arm 28 moves upward and forces the flange area 27 of the base plate 26 further into the chamfered groove 33 of cup 31. Close engagement of flange 27 in groove 33 forces the gasket 30 positioned between them to be drawn over the flange area 27 forming a larger diameter than that of the base plate 26. The drawing of the gasket 30 over the flange area 27 also provides a fluid-tight seal between the plug assembly 25 and the interior walls of the film container 1. The plug assembly 25 can be sealed in this manner at any position along the longitudinal axis of the film container 1 in which the assembly 25 is moved. Once the ring member 36 is pivoted downward, the plug assembly 25 is sealed and further movement of the assembly is not possible until the ring member 36 is pivoted back to the upward position thereby releasing the seal. Once the plug assembly 25 is thus secured or locked in a desired position, the volume within the film container 1 is defined and remains static until the plug assembly 25 is released and moved to a new position or removed from within the film container 1.

OPERATION

The suggested or preferred method of using the film drum for developing photographic film is described. It should be understood that the values used herein are merely illustrative and in addition the use of the film drum is not limited to photographic film, but rather includes the processing of any material by the application of fluids.

The initial step is to properly size the internal volume of the film container 1. To accomplish this, the plug assembly 25 is unsealed by pivoting the ring member 36 to the vertical position permitting the assembly 25 to move with only a little friction within the film container 1. The entire film drum 10 is placed in a vertical or upright position with the plug assembly end resting on a flat horizontal surface. The cover assembly 8 is unsealed and removed by rotating the assembly unmating the extensions 11 and the tabs 7. At this point, it is important to visually inspect the film drum and the reels to insure that they are dry and free of chemicals which could contaminate the developing process. Without loading the film onto the reels, standard side loading reels are suggested, the number of reels to be used are placed inside the film container 1. The cover assembly 8 is now replaced and sealed. The entire film drum 10 is tilted slightly from its vertical rest position enabling the user to reach the plug assembly 25. The plug assembly 25 is moved within the interior of the film container 1 toward the sealed cover assembly 8. The plug assembly 25 is moved in such a manner until the reels contact the cover assembly 8 and the plug assembly contacts the bottom reel. The plug assembly 25 is now sealed by pivoting the ring member 36 to its horizontal position. The interior volume of the film container 1 is now sized to the minimum volume required for the number of reels to be used. The suggested maximum capacity for the film drum 10 is four (4) 120 reels or six (6) 35 mm. reels or thirteen (13) 16 mm. reels or any appropriate combination thereof. The cover assembly 8 is now removed and the reel(s) taken out of the film container 1. In the darkroom, the film is loaded onto the reels in the usual manner. The loaded reels are placed into the film container 1 and the cover assembly 8 is replaced and sealed. The user can now begin the process of daylight developing the loaded film since the film drum is both fluid and light-tight.

Suggested solution quantities are listed below in Table I. These quantities are volumes required per reel for each film size based on side loading reels and a half-full film container. It is only required that the film container 1 be half-full when the agitating is done by manually rolling the film drum on a horizontal surface or by using the UNICOLOR ® Uniroller.

TABLE I

| FILM SIZE | SOLUTION VOLUME PER REEL |
|---|---|
| 110 | 2 oz. (60 ml) |
| 35 | 4 oz. (120 ml) |

TABLE I-continued

| FILM SIZE | SOLUTION VOLUME PER REEL |
|---|---|
| 120 | 8 oz. (240 ml) |

NOTE: A standard center loading reel requires approximately one (1) oz. (30 ml) more solution per reel than indicated in the above side loading reel Table.

To pour developing chemicals into or draining chemicals out of the film container, remove the cap 24. It is possible to tilt the drum at an angle and rest it upon any type of support structure to make pouring easier. The cap 24 must be repositioned over the container structure before the drum is again agitated. Since the film drum is air-tight, back pressure which resists the positioning of the cap 24 may be experienced. In this case, lift the edge of the cap 24 while positioning it over the container structure to vent trapped air.

Some processes require careful temperature regulation and for these the film drum is presoaked. In the preferred embodiment, the double cylinder structure holds the presoak temperature to close tolerances. To properly presoak, fill the drum container with tempered presoak water and allow it to set for one (1) full minute before processing. In order to properly wash the developed film, both the cover assembly 8 and the plug assembly 25 are removed and the developed film left in the film container. The container is placed in the opposite vertical position used when pouring fluids into the film container 1. In this situation, however, running water is let pass in the end previously sealed by the plug assembly and flow out the end previously sealed by the cover assembly. To facilitate easy flow of the water out of the film container, the edge of the film drum has a plurality of indents 41, shown in FIG. 2. Of course, other means of allowing the water to freely flow out of the end of the film container could be used such as a small stand to lift the end of the container off the flat horizontal surface and naturally, the indents 41 could be at either end of the container structure.

An example of a step-by-step instruction is given in Table II for Unicolor K2, Kodak C41 processes, etc. for film types Kodacolor 2, Vericolor 2, types 5247, SO-245, SO-267, SO-276, etc. which are high temperature color negative processes. Here a presoak is required and the presoak temperature always equals the developer temperature.

TABLE II

| STEP | USE THIS SOLUTION | AT THIS TEMPERATURE | FOR THIS TIME | WITH THIS TECHNIQUE |
|---|---|---|---|---|
| 1. | Water | 100±½° F. (37.8±0.3° C.) | 1 min. | Fill drum and allow to stand one (1) full minute. Drain completely. |
| 2. | Developer | 100±½° F. 37.8±0/3° C.) | 3-¼ min. TIME CRITICAL for consistent results . . . | Pour in enough tempered, developer to half-fill drum (see Table I). Place on UNICOLOR ® Uniroller, turn switch on and start time immediately. Remove film drum from Uniroller near end of step so as to include drain time in total for step. Make certain to drain completely. Note: Agitation can be done manually. |
| 3. | Blix | 100±5° F. (37.8±3° C.) | 6-7 min. Time not critical beyond minimum | Pour in enough tempered Blix to half-fill film drum. Place on Uniroller, turn switch on and start time. Note: Agitation can be done manually. |
| | | The remaining steps can be done in normal roomlight with film drum lid off. | | |
| 4. | (Running Water) | 100 ± 5° F. (37.8±3° C.) | 3-4 min. Time Not Critical beyond minimum | |
| 5. | Stabiliz-er | 75°-105° F. (24°-41° C.) | 1-2 min. Time Not critical beyond minimum. | Stabilizer can usually be prepared in tap water. However, a good practice is to use distilled or deionized water. |
| 6. | Dry | 75°-105° F. (24°-41° C.) | — | DO NOT SQUEEGEE FILM Hang in dust-free area. Remember to wash film drum parts thoroughly. |

It is to be understood that the present disclosure can be modified or varied by applying current knowledge without departing from the spirit and scope of the novel concepts of the invention.

I claim:

1. A variable volume daylight photographic developing tank for processing photographic material through the application of photographic processing fluid to said photographic material comprising:

a deposit container for holding said photographic material in a position to be contacted by said photographic processing fluid during processing and having at least one open end;

a plug means insertable through said open end of said container and movable within said container for varying the volume within said container to attain the minimum internal container volume necessary for the amount of photographic material to be processed; and an amount of said photographic processing fluid proportional to said minimum internal container volume partially filling said minimum internal container volume during processing.

2. A variable volume daylight photographic developing tank for processing photographic material through the application of photographic processing fluid to said photographic material comprising:

a deposit container for holding said photographic material in a position to be contacted by said photographic processing fluid during processing and having first and second open ends;

a fluid-flow control means connected at said first open end of said deposit container for permitting the entry of said photographic processing fluid into said container;

a plug means insertable through said second open end of said deposit container and movable within said deposit container for varying the internal volume of said deposit container defined by the interior surface of said deposit container, said fluid-flow control means and said plug means to attain the minimum internal container volume necessary for processing said photographic material; and an amount of said photographic processing fluid proportional to said minimum internal container volume partially filling said minimum internal container volume during processing.

3. A variable volume daylight photographic developing tank as set forth in claim 2 wherein said plug means is securable within said deposit container for forming an impermeable seal between said plug means and the internal walls of said deposit container.

4. A variable volume daylight photographic developing tank for processing photographic material through the application of photographic processing fluid to said photographic material comprising:

an insulated container for holding said photographic material in a position to be contacted by said photographic processing fluid during processing and having first and second open ends;

said insulated container having a predetermined original internal volume defined by the internal surface of said container and a plane perpendicular to the axis of said container at both said first and second open ends;

a fluid-flow control means connected at said first open end of said container for permitting the entry of said photographic processing fluid into said container;

a plug means positionable at said second open end of said container and movable within said container for attaining the minimum internal container volume necessary to process said photographic material;

said minimum internal container volume defined by the interior surface of said container, said fluid-flow control means and said plug means;

said plug means securable within said container for forming an impermeable seal between said plug means and said interior surface of said container; and, an amount of said photographic processing fluid proportional to said minimum internal container volume partially filling said minimum internal container volume during processing.

5. A variable volume daylight photographic developing tank for processing photographic material through the application of photographic processing fluid to said photographic material comprising:

a deposit container for holding said photographic material in a position to be contacted by said photographic processing fluid during processing and having first and second open ends;

a fluid-flow control means connected at said first open end of said deposit container for permitting the entry of said fluid into said container and comprising:

a funnel-shaped element having a minor and major orifice;

said funnel element receiving said fluid through said major orifice;

a plurality of vanes for directing the flow of said fluid and prohibiting light from entering said container; and, said plurality of vanes radially extending from the minor orifice of said funnel element;

a plug means insertable through the said second open end of said deposit container and movable within said deposit container for varying the internal volume of said deposit container defined by the interior surface of said deposit container, said fluid-flow control means and said plug means to attain the minimum internal container volume necessary for processing said photographic material; and a measured amount of said fluid partially filling said minimum container volume during processing.

6. A variable volume daylight photographic developing tank as set forth in claim 5 wherein said fluid-flow control means further comprises:

a removable cap for sealing said major orifice of said funnel-shaped element in the attached position and permitting fluid flow into or out of said container in the removed position.

7. A variable volume daylight photographic developing tank for processing photographic material through the application of photographic processing fluid to said photographic material comprising:

an insulated container for holding said photographic material in a position to be contacted by said photographic processing fluid during processing and having first and second open ends;

said insulated container having a predetermined original internal volume defined by the internal surface of said container and a plane perpendicular to the axis of said container at both said first and second open ends;

a fluid-flow control means connected at said first open end of said container and comprising:

a funnel-shaped element having a minor and major orifice;

said funnel element receiving said fluid through said major orifice;

a plurality of vanes for directing the flow of said fluid and prohibiting light from entering said container;

said plurality of vanes radially extending from the minor orifice of said funnel element; and, a removable cap for sealing said major orifice of said funnel-shaped element in the attached position and permitting fluid flow into or out of said container in the removal position;

a plug means positionable at said second open end of said container and movable within said container for attaining the minimum internal container volume necessary to process said photographic material;

said minimum internal container volume defined by the interior surface of said container, said fluid-flow control means and said plug means;

said plug means securable within said container for forming an impermeable seal between said plug means and said interior surface of said container; and, a measured amount of said fluid partially filling said minimum internal container volume during processing.

8. A variable volume daylight photographic developing tank for processing photographic material through the application of photographic processing fluid to said photographic material comprising:

a substantially cylindrical deposit container for holding said photographic material in a position to be contacted by said photographic fluid during processing and having first and second open ends;

a fluid-flow control means connected at said first open end of said deposit container for permitting the entry of said fluids into said container;

a plug means insertable through the said second open end of said deposit container and movable within said deposit container for varying the internal volume of said deposit container defined by the interior surface of said deposit container, said fluid-flow control means and said plug means to attain the minimum internal container volume necessary for processing said photographic material;

a measured amount of said fluid partially filling said minimum container volume during processing; and, means for insulating said deposit container comprising:

a substantially cylindrical insulating container of a greater diameter and shorter length than said deposit container; said insulating container positioned concentrically to said deposit container and connected thereto for defining an annular chamber between said containers; and, said annular chamber filled with insulating material.

* * * * *